US006318167B1

(12) United States Patent
Power

(10) Patent No.: US 6,318,167 B1
(45) Date of Patent: Nov. 20, 2001

(54) VOLUMETRIC TEST STAND CYLINDER MONITOR/CONTROLLER

(75) Inventor: William Power, Sanford, NC (US)

(73) Assignee: Parker-Hannifin Corp., Cleveland, OH (US)

( * ) Notice: Subject to any disclaimer, the term of this patent is extended or adjusted under 35 U.S.C. 154(b) by 0 days.

(21) Appl. No.: 09/305,267

(22) Filed: May 4, 1999

Related U.S. Application Data

(60) Provisional application No. 60/084,126, filed on May 4, 1998.

(51) Int. Cl.[7] ..... F04B 51/00; G01M 19/00
(52) U.S. Cl. ..... 73/168; 73/112; 73/37
(58) Field of Search ..... 73/168, 37, 112

(56) References Cited

U.S. PATENT DOCUMENTS 3,270,557 * 9/1966 McClocklin ..... 73/168
4,368,638 * 1/1983 Groves et al. ..... 73/168
4,798,086 * 1/1989 Styfhoorn ..... 73/168
4,993,259 * 2/1991 LaFountain ..... 73/168
5,103,671 * 4/1992 Dyvig ..... 73/168
5,272,917 * 12/1993 Pippert ..... 73/168

* cited by examiner

*Primary Examiner*—Hezron Williams
*Assistant Examiner*—David J. Wiggins
(74) *Attorney, Agent, or Firm*—Christopher H. Hunter

(57) ABSTRACT

A test device and a process for determining the accuracy of positive displacement gear pumps includes hydraulic cylinders which are fluidly connected to the output fluid flow(s) from a test pump. Each outlet flow is directed to a separate hydraulic cylinder. The test pump is driven by a motor for a preset number of revolutions. The length of stroke of the piston in each hydraulic cylinder is then determined, which corresponds to the volume of fluid provided from each pump outlet during the revolution of the gears in the pump. It can then be determined if the volumetric accuracy and efficiency of the pump is within acceptable limits.

32 Claims, 3 Drawing Sheets

VOLUMETRIC TEST STAND CYLINDER MONITOR/CONTROLLER

RELATED CASES

The present application claims priority to U.S. Provisional Application Ser. No. 60/084,126, filed May 4, 1998.

FIELD OF THE INVENTION

The present invention relates generally to a test device and a testing process for determining the accuracy and efficiency of positive displacement gear pumps.

BACKGROUND OF THE INVENTION

Properly maintained gear pumps require volumetric metering and stream-to-stream accuracy throughout the life of the pump. Also, in order to ensure that the precision of the pump is established upon installation, and reestablished after routine maintenance, it is necessary to test the pumps prior to installation and after any maintenance. Traditionally, many fiber producers have custom-designed their own testers, or foregone testing altogether and relied upon their service technicians' expertise and their own testers. It is believed that most of these testers have utilized the "collect and weigh" method, where the output of the pump is collected for a period of time, and then compared to theoretical values to determine the efficiency of the pump. These testers, besides being messy and allowing contaminants into the test oil, require manual weighing, conversion from weight to volume based upon specific gravity at temperature, and calculation/recording of test results.

It is believed there is a demand for a fully-contained method of measuring volumetric accuracy which requires no weighing of output result, weight conversions, or manual recording/calculations, and eliminates mess and risk of contamination.

SUMMARY OF THE PRESENT INVENTION

The present invention provides a novel and unique test device and a testing process for determining the accuracy and efficiency of positive displacement gear pumps. The technique requires no weighing of output result, weight conversions, or manual recording/calculations, and eliminates the mess and risk of contamination.

According to the present invention, a series of hydraulic cylinders are arranged to receive the output fluid stream(s) from a test pump. Each fluid stream is directed to a separate hydraulic cylinder. A position sensor is connected to the cylinder piston to measure the stroke of the piston. After a predetermined number of revolutions of the drive shaft driving the gears of the test pump, the stroke of the cylinder piston is determined. Knowing the volume of the cylinder and the number of revolutions of the gears in the test pump, the output of the pump can be accurately and easily calculated.

The output of the pump is then compared with allowable limits, and the test results are displayed. The entire calculations can be performed using electronic circuitry such as a multiple transducer interface. Directional control valves control the flow to the test pump and to the hydraulic cylinders, and return the flow to a tank when the pump is not being tested. The directional control valves also direct flow to the opposite end of the hydraulic cylinders to purge and ready the cylinders for the next test.

Further features and advantages of the present invention will become apparent to those skilled in the art upon reviewing the following specification and attached drawings.

DETAILED DESCRIPTION OF THE PREFERRED EMBODIMENT

Figure 2:
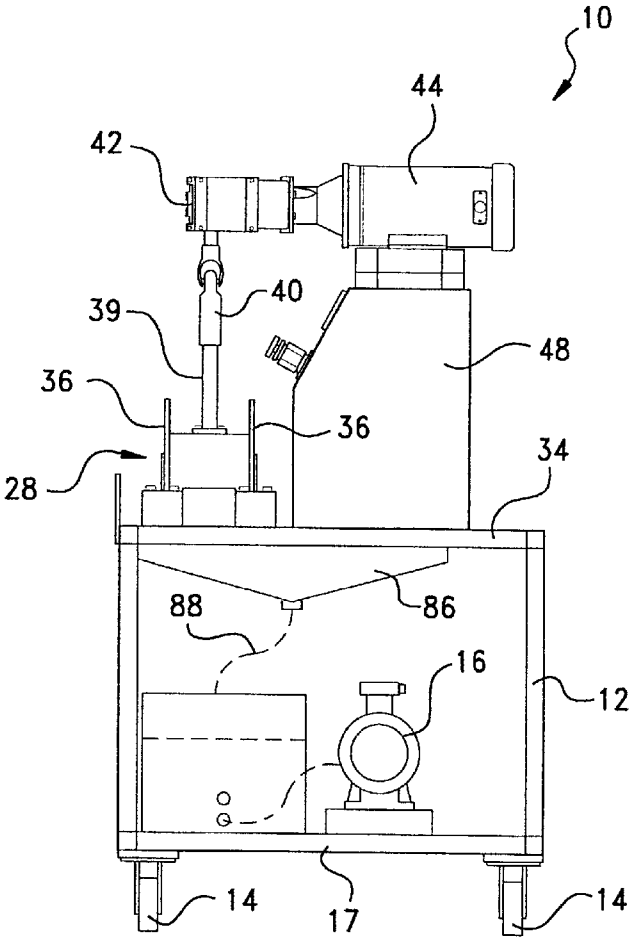
FIG. 2 is an end view of the test device of FIG. 1.

Referring to the drawings, a test device constructed according to the principles of the present invention is indicated generally at 10. The test device includes a cart or stand 12 which is movably supported on wheels 14. An inlet supply pump 16 is supported on the base 17 of the cart and driven by a motor 18. Pump 16 receives fluid from a tank 20 through an inlet line 22, and supplies the fluid under pressure through an outlet line 24 (FIG. 4) to a directional control valve or contact closure 25, and then through an outlet line 26 to a pump to be tested, indicated generally at 28. Directional control valve 25 directs the fluid back along return line 29 to tank 20 until the testing of pump 28 is to begin.

Figure 1:
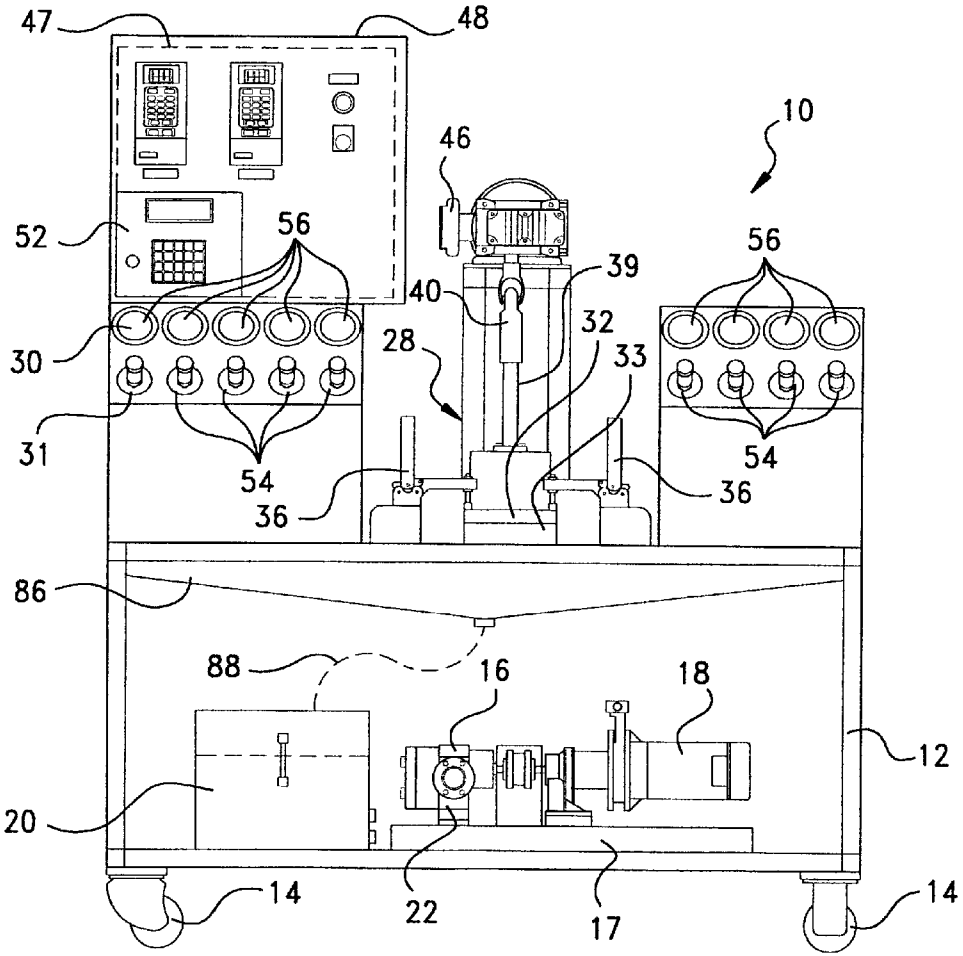
FIG. 1 is a side view of a volumetric test device constructed according to the principles of the present invention.

The inlet pressure to pump 28 can be sensed and adjusted by gauge 30 and relief valve 31 (FIG. 1). Gauge 30 and relief valve 31 are commercial products available from the assignee of the present invention.

The test device 10 is designed to handle up to eight fluid outputs from the test pump. To this end, test pump 28 is mounted on an adapter block 32 and a porting block 33 to the upper support shelf 34 of cart 12. A series of clamps 36 retain the pump on the shelf. The drive shaft of the test pump is connected to a drive shaft 39, which is connected to a coupling 40, and through a reducer 42 to a DC drive 44. The DC drive 44 is a commercial motor provided by the assignee of the present invention.

The pump drive is equipped with a magnetic sensor or pick-up 46 which is used for closed loop speed control. Sensor 46 is a Madison Electric Magnetic Pick-Up Assembly. The signal from the sensor 46 is provided to electronic processing circuitry 47 located within cabinet 48. The motor runs at a maximum speed of 50 rpm, and there are 60 teeth on the gear of the sensor/pick-up, which provides a maximum of 3000 pulses per minute. The circuitry 47 includes a multiple transducer interface 52, commercially available from Carolina Motion Control, Inc. under Model No. MTI-800, which operates at 220 VAC, single phase at 50–60 Hz. The multiple transducer interface can monitor the position of up to eight magnetostrictive linear displacement transducers, and the output from the interface can be configured to control the position of the directional valves for closed loop control.

The fluid outputs from the pump 28 are each connected through individual outlet lines 53 to individual relief valves, as indicated at 54, and gauges 56, with one gauge for each valve. The input and outlet flow pressures to pump 28 can be adjusted as required through valves 27, 54; and through the speed adjustment of motor 44. Valves 54 and gauges 56 are commercially-available products provided by the assignee of the present invention.

The outlet from each pressure control valve 54 is provided along a line 60 to a directional control valve or contact closure 62. The outlets are connected through the directional control valve 62 and through an outlet line 65 to a hydraulic cylinder 66 in the test mode, and through a return line 67 to tank 20 in a recirculating mode. The directional control valve 62 is illustrated as a 230 volt AC solenoid-operated directional control valve. The directional control valves 62 are controlled from the operator interface on the multiple transducer interface 52.

Figure 3:
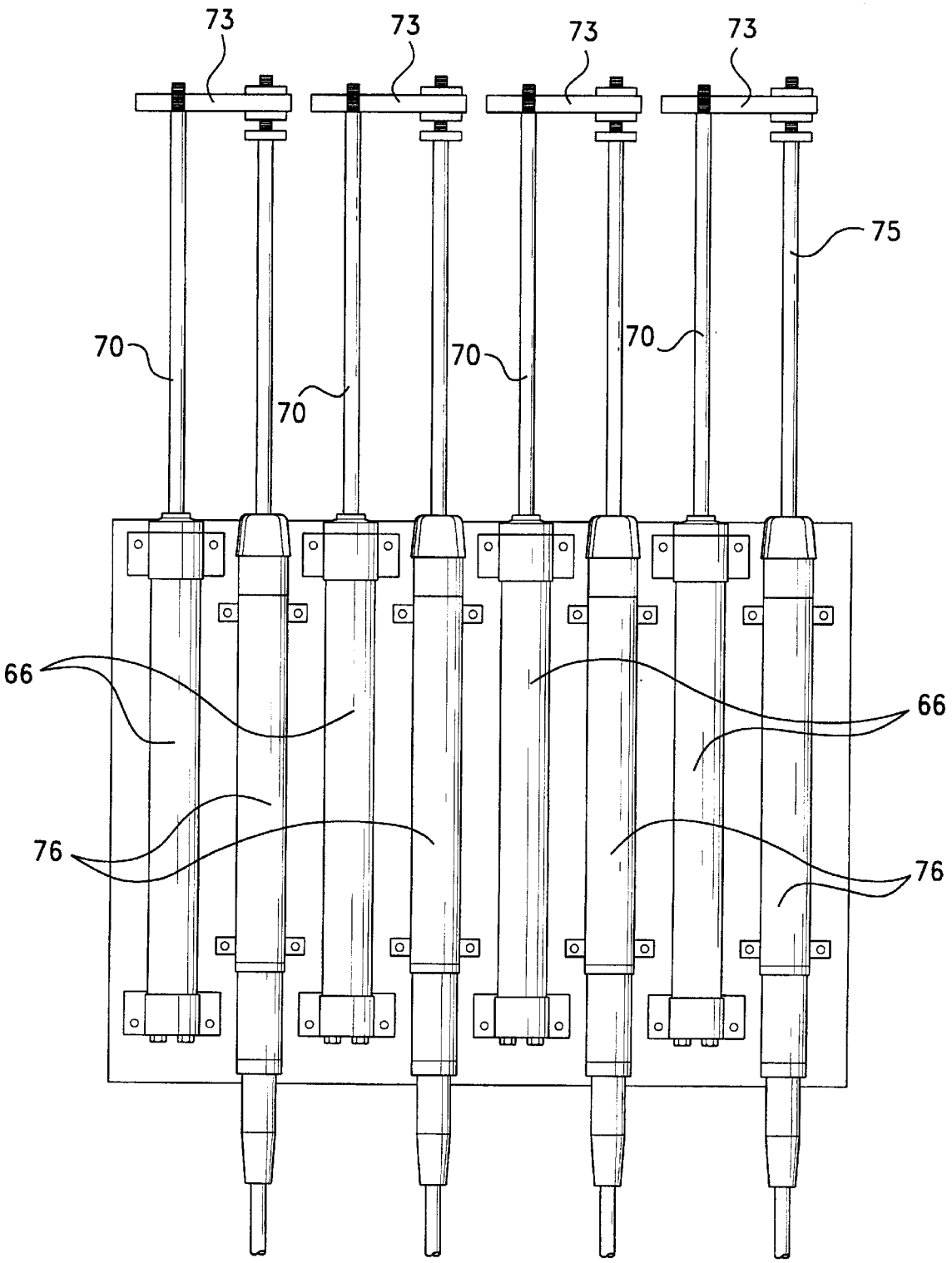
FIG. 3 is a plan view of the plurality of cylinders used in the test device of FIG. 1.
Figure 4:
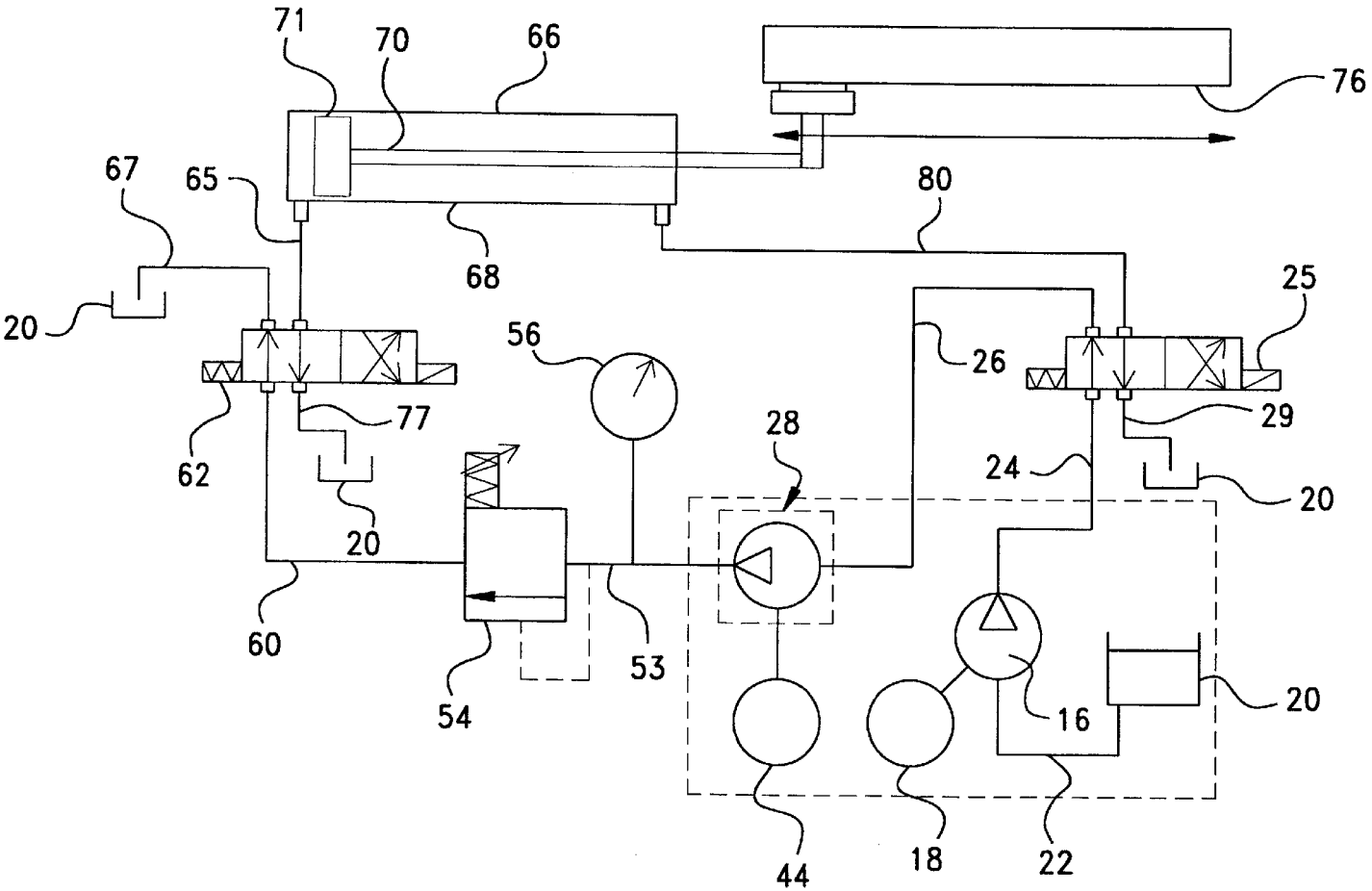
FIG. 4 is a schematic illustration of the flow circuit for each cylinder of the test device.

Up to eight hydraulic cylinders 66 can be provided (one for each output flow from the test pump), although only four such cylinders are shown in FIG. 3. Referring now to FIG. 4, each cylinder 66 includes an outer housing 68 enclosing a piston 70 having a piston head 71. The outlet line 65 from the directional control valve 62 is fluidly connected to the forward end of the cylinder housing 68 (i.e., to the forward end of piston head 71) to drive the piston 70 along its stroke. The free end of each cylinder piston 70 extends outwardly from the housing and is connected through a plate 73 to the free end of a rod 75 of a linear position sensor 76. Four of such sensors 76 are shown in FIG. 3, with one sensor provided for each of the hydraulic cylinders. The linear sensors 76 are illustrated as commercial products provided by MTS Systems Corporation under Model LP "Temposonics" Digital Position Sensor. The output signals from the sensors are provided to the multiple transducer interface 52.

The rear end of each cylinder housing 68 is fluidly connected through an outlet line 80 to directional control valve 25. During the test mode as the forward end of the cylinder is filling with fluid and the piston is moving along its stroke, any fluid in the rear end of the cylinder is dumped to tank 20 through line 29. After the test is complete, the directional control valve 25 can be set to allow fluid from pump 16 to enter the rear end of the hydraulic cylinder and move the piston 70 back to its original, starting position. At this time, fluid is purged from the forward end of each cylinder 60 along return line 65, through directional control valve 62 and along return line 77 to tank 20. The operation of the directional control valves 25, 62 is controlled by the multiple transducer interface 52.

During a test of a pump, the testing can be started and stopped from the operator interface on the multiple transducer interface 52. The multiple transducer interface 52 initially polls the sensors 76 to determine which sensors are active (with the number of active sensors corresponding to the number of output flows from the pump). The speed and inlet and outlet pressures of the test pump 28 are then monitored and adjusted as required. Once the pump is running smoothly, the pump part number is input to the multiple transducer interface 52 so that the allowable limits can be recalled, and the test of the pump is ready to begin. The directional control valves 62 divert the flow of the test pump from a recirculating mode to a test mode. The fluid from each pump outlet then enters a respective hydraulic cylinder, and the piston of each cylinder begins moving along its stroke. The multiple transducer interface counts the revolutions of the test pump through pickup 46 until a preset number of pump revolutions is reached. After the preset number of pump revolutions is reached, the length of the stroke of each cylinder is determined.

The stroke of each cylinder is converted to a volume measurement by the following basic formula for volume:

$$\text{Volume (in}^3\text{)}=0.7854(D^2)(h)(16.39)=0.7854\times1\times\text{stroke}\times16.39=\text{stroke}\times12.8727$$

where D=1 (the diameter of the cylinder in inches), and the 16.39 factor converts from cubic inches to cubic centimeters.

The formula may be changed to represent a given stroke, rather than volume.

The pump flow (from each pump output) can be determined by multiplying the length of stroke times the volume measurement, divided by the number of revolutions of the pump. This formula is as follows:

$$\text{Pump flow (cc/rev.)}=\text{stroke}\times12.872676/\#\text{revs.}$$

A one inch diameter cylinder was used. The multiple transducer interface preferably allows input of the cylinder dimensions.

Using the above inputs, the multiple transducer interface then calculates the flow from each pump outlet, compares that number with the allowable limits, and displays the test results on the interface 52 so as to provide an indication whether the pump is working efficiently. The multiple transducer interface 52 can then also send a signal to the directional control valve 25 and to directional control valves 62 to reroute the fluid to the rear end of the cylinders 66 to ready the cylinders for the next test. The directional control valves 62 then divert the flow of the test pump from a test mode to a recirculating mode.

A pre-test period is needed at the beginning of the test, in which the multiple transducer interface 52 is not counting. The length of the pre-test period will default to five revolutions of the pump, changeable only from the set-up program. This will ensure that the hydraulic cylinders are moving freely and in motion when the measurement begins. The multiple transducer interface will then send a signal to the directional control valves 62 to route the fluid to the cylinders for the test.

The results of the test can be downloaded to a personal computer via a serial output.

Any leakage from pump 28 during the test is collected by a drain pan 86 and returned by drain line 88 to tank 20.

Thus, as described above, the present invention provides a novel and unique test device and a testing process for determining the accuracy and efficiency of positive displacement gear pumps. The test device provides a fully-contained method of measuring volumetric accuracy which requires no weighing of output result, weight conversions, or manual recording/calculations, and eliminates the mess and risk of contamination.

The principles, preferred embodiments and modes of operation of the present invention have been described in the foregoing specification. The invention which is intended to be protected herein should not, however, be construed as limited to the particular form described as it is to be regarded as illustrative rather than restrictive. Variations and changes may be made by those skilled in the art without departing from the scope and spirit of the invention as set forth in the appended claims.

What is claimed is:

1. A test device for testing the accuracy and efficiency of a positive displacement test pump, the test device comprising:

a hydraulic cylinder having a moveable piston, an inlet to one end of the cylinder connectable to an outlet of the test pump, and an outlet at the other end of the cylinder;

means for rotating a drive shaft of the test pump to provide fluid to the inlet of the hydraulic cylinder and for monitoring the rotation of the drive shaft of the test pump;

means for sensing the movement of the piston in the cylinder as the cylinder receives fluid from the test pump; and means for calculating the volume of the fluid provided to the hydraulic cylinder based on the movement of the cylinder piston and the rotation of the drive shaft of the test pump, and for calculating whether the output of the test pump is within allowable limits.

2. The test device as in claim 1, further including display means for displaying the results of the calculations of whether the output of the test pump is within the allowable limits.

3. The test device as in claim 1, further including multiple hydraulic cylinders, each cylinder having a moveable piston, an inlet to one end of the cylinder connectable to an outlet of the test pump, and an outlet at the other end of the cylinder.

4. The test device as in claim 1, and further including a moveable cart supporting the test device and having a support surface for locating a pump to be tested.

5. The test device as in claim 4, and further including an inlet supply pump mounted on the cart and connectable to an inlet of the test pump to provide fluid under pressure to the test pump.

6. The test device as in claim 5, and further including a tank supported on the cart for holding a fluid to be supplied by the inlet supply pump to the test pump.

7. The test device as in claim 6, and further including a return line fluidly connecting the outlet of the hydraulic cylinder and the tank.

8. The test device as in claim 7, and further including a directional control valve controlling the flow of fluid between the inlet supply pump, the tank, the outlet of the hydraulic cylinder and inlet of the test pump.

9. The test device as in claim 6, and further including a return line connectable to the outlet of the test pump and to the tank.

10. The test device as in claim 9, and further including a directional control valve controlling the flow of fluid between the outlet of the test pump, the tank, and the inlet to the hydraulic cylinder.

11. The test device as in claim 1, and further including a pressure regulating valve to adjust the pressure of the fluid applied to the inlet of the test pump.

12. The test device as in claim 11, and further including a pressure regulating valve to adjust the pressure of the fluid provided at the outlet of the test pump.

13. The test device as in claim 1, wherein the piston is movable axially within the hydraulic cylinder.

14. A test device for testing the accuracy and efficiency of a positive displacement test pump, the test device comprising:

a hydraulic cylinder having a moveable piston, an inlet to one end of the piston connectable to an outlet of the test pump, and an outlet at the other end of the piston;

a motor connectable through a drive shaft to the pump to drive the test pump to provide fluid from the outlet of the test pump along an inlet line to the inlet of a hydraulic cylinder, and a pick-up to monitor the movement of the drive shaft of the test pump;

a sensor to sense the movement of the piston in the cylinder when the cylinder receives fluid from the test pump; and electronic processing circuitry connected to the pick-up and the sensor to calculate the volumetric efficiency of the test pump based on the movement of the piston and the movement of the drive shaft of the test pump.

15. The test device as in claim 14, further including display means for displaying the results of the calculations.

16. The test device as in claim 14, further including multiple hydraulic cylinders, each cylinder having a moveable piston, an inlet to one end of the cylinder connectable to an outlet of the test pump, and an outlet at the other end of the cylinder.

17. The test device as in claim 14, and further including a moveable cart supporting the test device and having a support surface for locating a pump to be tested.

18. The test device as in claim 17, and further including an inlet supply pump mounted on the cart and connectable to the test pump to provide fluid under pressure from the tank to the test pump.

19. The test device as in claim 18, and further including a tank supported on the cart for holding a fluid to be supplied by the inlet supply pump to the test pump.

20. The test device as in claim 19, and further including a return line fluidly connecting the outlet of the hydraulic cylinder and the tank.

21. The test device as in claim 20, and further including a directional control valve controlling the flow of fluid between the inlet supply pump, the tank, the outlet of the hydraulic cylinder and inlet of the test pump.

22. The test device as in claim 19, and further including a return line connectable to the outlet of the test pump and to the tank.

23. The test device as in claim 22, and further including a directional control valve controlling the flow of fluid between the outlet of the test pump, the tank, and the inlet to the hydraulic cylinder.

24. The test device as in claim 14, and further including a pressure regulating valve to adjust the pressure of the fluid applied to the inlet of the test pump.

25. The test device as in claim 24, and further including a pressure regulating valve to adjust the pressure of the fluid provided at the outlet of the test pump.

26. The test device as in claim 14, wherein the piston is movable axially within the hydraulic cylinder.

27. A test device for testing the accuracy and efficiency of a positive displacement gear pump, the gear pump having a single inlet and multiple outlets, the device comprising:

a moveable cart supporting the test device and having a support surface for locating the gear pump;

a series of hydraulic cylinders, each hydraulic cylinder having a moveable piston, an inlet to one end of the piston of each cylinder connectable to a respective outlet of the gear pump, and an outlet at the other end of the piston;

a motor connectable through a drive shaft to the gear pump to drive the test gear pump to provide fluid from each outlet of the gear pump along an inlet line to the inlet of a hydraulic cylinder, and a pick-up to monitor the driving of the gear pump;

sensor to sense the movement of the piston in the cylinder when the cylinder receives fluid from the gear pump;

electronic processing circuitry connected to the pick-up and to the sensor to calculate the volumetric efficiency of the gear pump based on the movement of the piston and the movement of the drive shaft of the gear pump; and a display to display the efficiency of the gear pump.

28. The test device as in claim 27, wherein the piston in each hydraulic cylinder is movable axially within the respective hydraulic cylinder.

29. A method for determining the efficiency of a positive displacement test pump having a drive shaft, comprising the steps of:

providing an inlet flow into the test pump;

rotating the drive shaft of the test pump and monitoring the rotation of a drive shaft;

directing an outlet flow from the test pump to a hydraulic cylinder, the hydraulic cylinder having a piston and the outlet flow from the test pump moving the piston;

sensing the movement of the piston in the hydraulic cylinder; and calculating the volumetric efficiency of the test pump based on the movement of the piston and the rotation of the drive shaft.

30. The method as in claim 29, further including the step of comparing the flow through the test pump with stored values of an acceptable range, and providing an indication of whether the flow is within the range.

31. The method as in claim 29, wherein the rotation of the drive shaft is monitored for a preset number of revolutions.

32. The method of claim 29, wherein the outlet flow from the test pump moves the piston axially within the hydraulic cylinder.

* * * * *